United States Patent [19]

Wietek

[11] Patent Number: 4,639,168

[45] Date of Patent: Jan. 27, 1987

[54] HOLLOW FOUNDATION BODY AND METHOD OF MAKING A FOUNDATION

[76] Inventor: Bernhard Wietek, A-6073, Sistrans No. 290, Austria

[21] Appl. No.: 576,384

[22] PCT Filed: Jan. 7, 1983

[86] PCT No.: PCT/AT83/00001

§ 371 Date: Jan. 13, 1984

§ 102(e) Date: Jan. 13, 1984

[87] PCT Pub. No.: WO83/04276

PCT Pub. Date: Dec. 8, 1983

[30] Foreign Application Priority Data

May 24, 1982 [AT] Austria ..... 2031/82

[51] Int. Cl.[4] ..... E02D 3/10; E02D 5/38

[52] U.S. Cl. ..... 405/239; 405/50; 405/233; 405/243; 405/267

[58] Field of Search ..... 405/50, 233, 239, 240, 405/243, 256, 36, 267; 166/285, 292

[56] References Cited

U.S. PATENT DOCUMENTS 2,622,683 12/1952 Silitch et al. ..... 405/36

3,277,962 10/1966 Flickinger et al. ..... 166/285 X 3,442,089 5/1969 Sollay ..... 405/243

3,512,365 5/1970 Muller ..... 405/243 X

FOREIGN PATENT DOCUMENTS 89620 7/1981 Japan ..... 405/50

*Primary Examiner*—David H. Corbin

*Attorney, Agent, or Firm*—McGlew and Tuttle

[57] ABSTRACT

To lower ground water in the region of foundation bodies, such as foundation piles and the like, a water-pervious layer of filtering concrete, in particular of uniform-grained concrete, is arranged below an upper water-impervious part which is made of standard concrete. From this layer the entering ground water is sucked through a pipe which extends through the foundation body and is designed as a water-pervious filter pipe in the region of the layer of filtering concrete. The layer of filtering concrete is preferably reinforced by reinforcing irons. After lowering of the ground water level, the filtering concrete is injected with a hardenable injection material, thus enabling the lower end of the foundation body to better absorb the pressures transmitted from the upper part.

6 Claims, 15 Drawing Figures

HOLLOW FOUNDATION BODY AND METHOD OF MAKING A FOUNDATION

FIELD AND BACKGROUND OF THE INVENTION

The invention relates to a hollow foundation body of substantially constant cross-section, consisting of concrete, which is downwardly extended by a water-pervious layer. A filter pipe is arranged in the water-pervious layer from which entering water can be removed through a pipe extending through the foundation body.

It has repeatedly been suggested to arrange drainage piles, which are generally used for lowering ground water in the region of foundation piles or walls, in a direction other than laterally with respect to the foundation structure. On the contrary, a pipe is passed through the foundation body into the underground, into which the ground water enters from a water-pervious layer located below the foundation body, whereupon it is pumped or sucked upwardly. Statically the filter layer located below the foundation body does not form part of the foundation body in known facilities of this kind see Austrain Patents Nos. 186,197 and 225,629.

SUMMARY OF THE INVENTION

It is the object of the present invention, compared with the afore-mentioned, to design a foundation body of the above-outlined kind, in particular a foundation pile, such that it first acts as a drainage pile in a manner known per se, but is at the same time statically effective over its full length. This result is obtained by forming the water-pervious layer of filtering concrete, in particular uniform grained concrete which is known per se.

Filtering concrete, and in particular uniform or like-grained materials, have been produced and were used for pre-fabricating filtering stones which were then arranged as required. When the like-grained material was introduced into the ground water region, as described in Austrian Patent No. 358,997, provisions had to be made to seal, on the one hand, the wall of the drilling hole and, moreover, to make the like-grained concrete impervious to ground water by admixing sufficient amounts of binding agent.

The resistance to pressure of the filtering concrete used according to the invention is greater than that of natural water-pervious layers or of a gravel jacket arranged around the filter pipe.

It is further possible to provide the whole foundation body with a continuous reinforcement. As soon as the ground water level has been sufficiently lowered the filtering concrete can, further, be injected under pressure with a hardenable injection material. This has already been suggested see Austrian Patent No. 168,946 to make a filter layer impervious to water. In conjunction with the invention this further results in the fact that the lower end of the foundation body is better able to absorb pressures transmitted from the upper part thereof.

BRIEF DESCRIPTION OF THE DRAWINGS

Details of the invention will be described below with reference to the drawing, in which.

DESCRIPTION OF PREFERRED EMBODIMENTS

Figure 1:
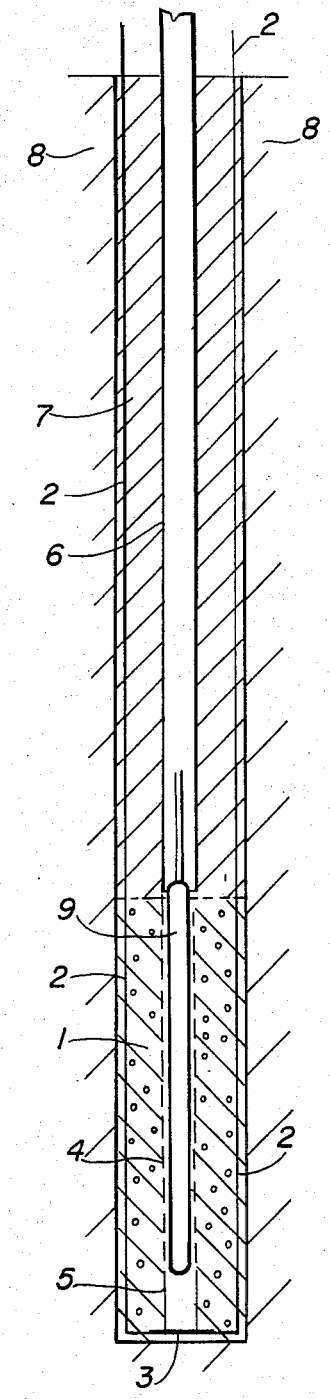
FIG. 1 shows a cross-section through a drainage pile.
Figure 3C:
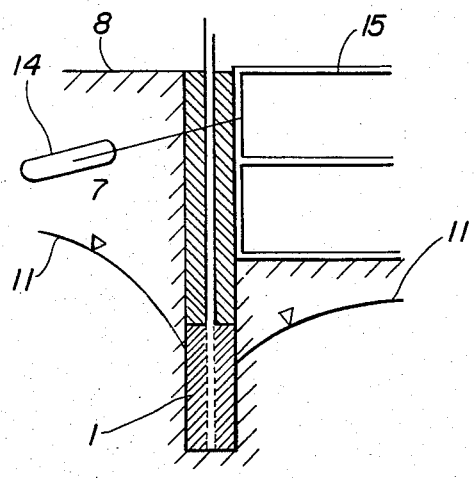
FIGS. 3*a* to 3*d* show the use of the described piles during the construction of a building.

The drainage pile illustrated in FIG. 1 comprises a lower part of filtering concrete 1 and an upper part of water-impervious normal concrete 7. It is continuously provided with longitudinally extending reinforcing irons 2 which are held together by helical reinforcing irons extending in circumferential direction. Pipes 6 and 4 extend along the axis of the pile surrounded by the soil 8. The pipe surrounded by the filtering concrete 1 is designed as water-pervious filter pipe 4 and, accordingly, provided with slots or the like. A bottom plate 3 with a swamp pipe 5 welded thereto prevents washing-out of the soil below the drainage pile. 9 indicates a removable rubber packer which prevents the concrete from entering inside the filter pipe 4 while the layer of filtering concrete 1 is made. The pile is vertically elongated and has a constant transverse cross-section.

Figure 2A:
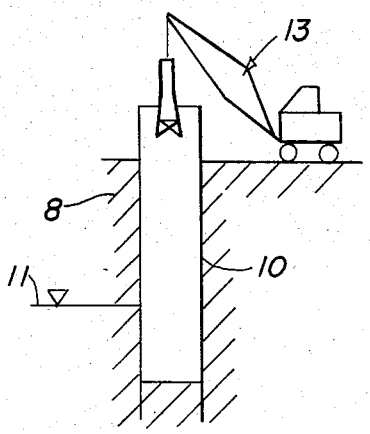
FIGS. 2*a* to 2*g* illustrate the steps of making the pile of FIG. 1.
Figure 2B:
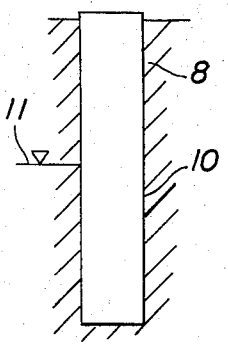
Figure 2C:
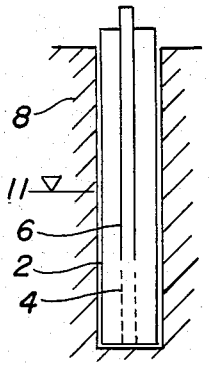
Figure 2D:
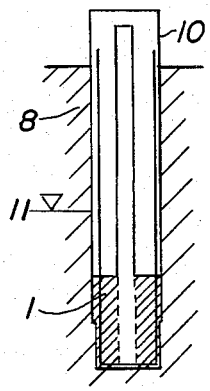

The illustrated drainage pile is made by first lowering a jacket pipe 10 into the soil 8, as below the ground water level 11 (FIGS. 2*a*, 2*b*). The soil in the interior of the jacket pipe 10 is removed by means of conventional construction machines 13. Then, the pipe 6 is inserted (FIG. 2*c*) which carries at its lower end the filter pipe 4, the swamp pipe 5 and the bottom plate 3. Filtering concrete 1 is placed around the reinforcing irons 2, and the jacket pipe 10 is pulled upwards at the same time (FIG. 2*d*).

The filtering- or like-grained concrete known per se preferably consists of gravel having a uniform grain size between 2 mm and 32 mm and contains about 120 to 200 kg of cement per $m^3$ of filtering concrete. Only a relatively small amount of water must be admixed as only superficial bonding between the cement particles and the gravel grains is required. The water required for the complete setting of the concrete is added when the materials are introduced under the water, where ground water is present anyway. To ensure the bond between the cement and the gravel, when great amounts of water enter, commercially available additives may be used which prevent the cement from being separated from the gravel grains. They are usually present in an amount of between 0.3 and 0.8% by weight.

The whole concrete (also like-grained concrete) is, as is usual at present, introduced to the corresponding height (depth) of the drainage pile by means of a concreting pipe.

Figure 2E:
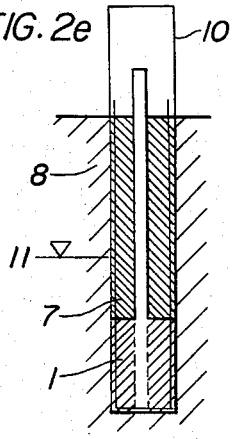
Figure 2F:
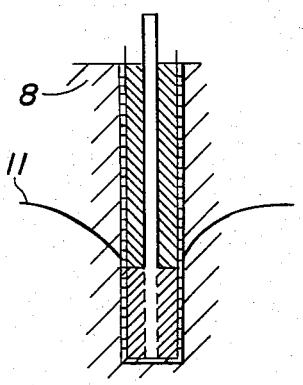
Figure 2G:
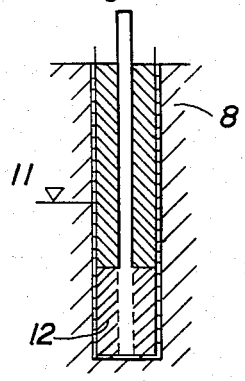

While the filtering concrete 1 is introduced, the filter pipe 4 may, as already mentioned, be sealed by a rubber packer 9. During the setting process, however, the filtering concrete may be washed to remain water-pervious. When the layer of filtering concrete 1 has been made, the upper part of the drainage pile is made of normal concrete 7 (FIG. 2*e*). The ground water level 11 is lowered (FIG. 2*f*) in that the water which entered via the filter pipe 4 is pumped upwardly by means of a pump introduced through the pipe 6 or in that it is sucked off from above. When no further drainage is required, a cement injection 12 may be injected into the filtering concrete 1 through the filter pipe 4 and, thus, the concrete be made water-impervious and provided with greater resistance to pressure. The material 12 may be thin cement mortar.

The structure according to the invention of a foundation pile used for drainage allows for the difference to which such structural element is exposed in its various regions of height: bending stresses are substantially restricted to the upper part in which the pile is constructed in a conventional manner, in the lower part, however, substantially only pressure loads occur which can easily be absorbed by reinforced filtering concrete. The lower part which at first serves primarily for drainage, hence, effects that the peak pressure at the pile bottom is reduced to the admissible amount. This is caused by friction along the whole length of its outer surface.

Figure 3A:
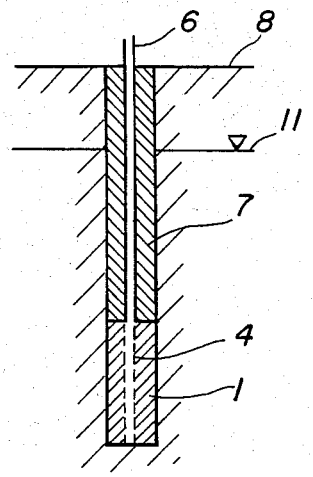
Figure 3B:
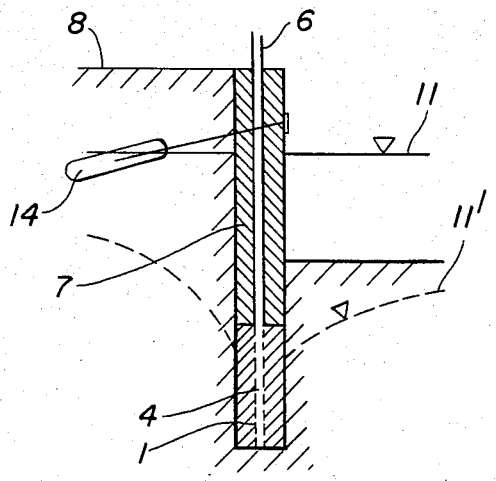

The kind of action of the drainage pile according to the invention during the construction process is illustrated by means of FIGS. 3*a*–3*d*. First, as already described, a number of piles are produced according to FIG. 3*a*. Then the building pit is excavated (FIG. 3*b*). In the course of said excavation an anchoring by means of anchors 14 as additional security means against occurring earth pressure is possible. Low water excavation can be carried out below the ground water. If this is not desired, it is possible to lower the ground water level sectionally already at this point. The main stress on the pile is the absorption of bending moments which are produced by the earth pressure. The occuring bending moments are absorbed by the provided reinforcement 2. The reduction of the cross-section by the well pipe 6 has only a negligible influence on said bearing behaviour, because the well pipe 6 is centrically arranged and is, hence, located in the neutral zone of the bending stress.

After excavation of the building pit (under certain circumstances also during excavation) the ground water is drawn off by the lower section of the filtering concrete 1 of the pile and pumped off through the well pipe 6. With respect to dimensioning, the same conditions as in the case of an ordinary well (FIG. 3*c*) prevail. Subsequently, the undergound part of the structure is built so that a watertight tank is formed.

Figure 3D:
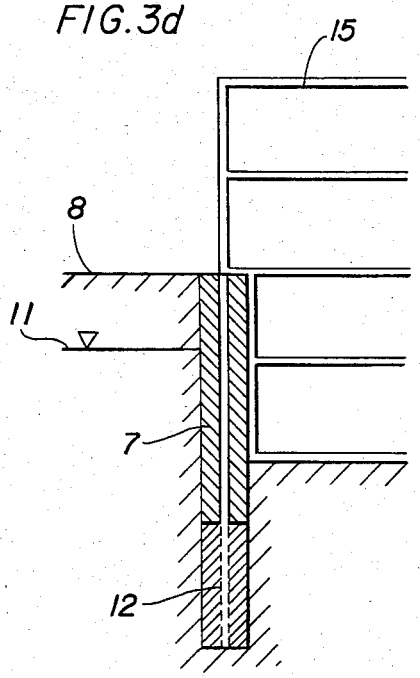

After the construction of the undergound part of the structure, the above-ground structure is built (FIG. 3*d*). As soon as the safety against uplift of the structure is guaranteed due to the increasing load, lowering of the ground water can be stopped. To increase the bearing capacity of the piles it is possible to further improve the like-grained concrete 1 by means of injections 12 through the filtering pipe 4. In doing so, not only the bearing capacity of the pile but also the friction on the outside surface is increased in this region, because the injection material partly enters into the surrounding subsoil. Thus, in the course of construction progress the pile obtains an increased bearing capacity, which may reasonably be adjusted to the increasing structural load.

The invention is not restricted to a foundation body of cylindrical cross-section, which means to foundation piles in a more restricted sense, but it is further possible to realize the same basic conception with foundation bodies of rectangular cross-sections.

Figure 4A:
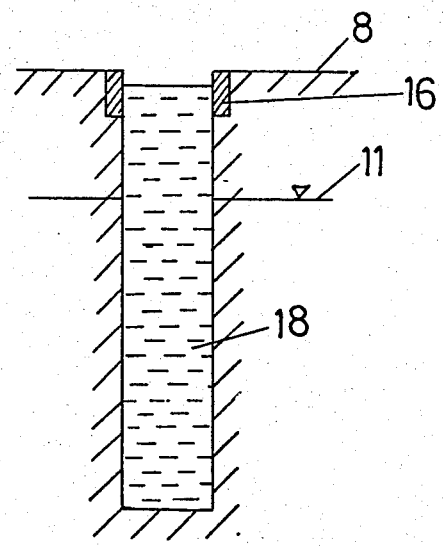
FIGS. 4*a* to 4*c* show the invention being applied with a drainage wall.
Figure 4B:
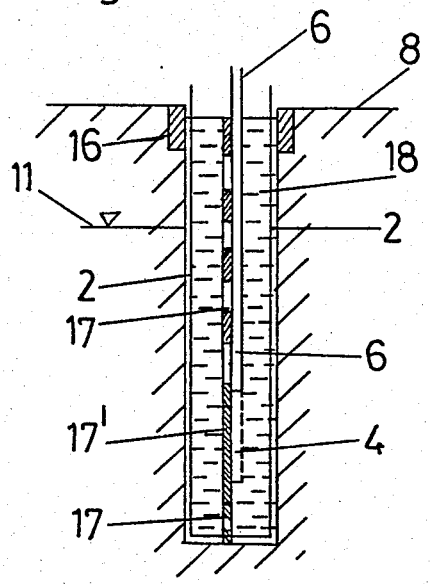
Figure 4C:
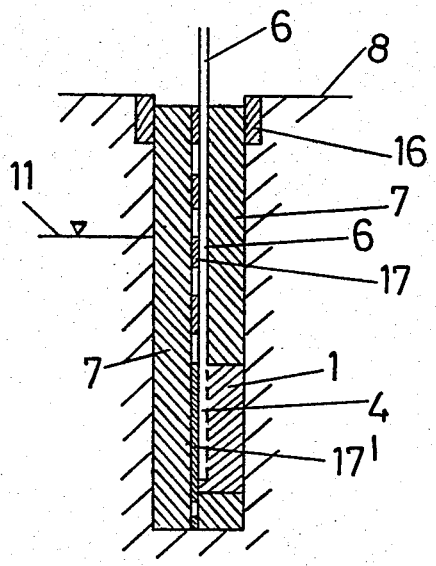

The building of such a drainage wall is illustrated in FIGS. 4*a* to 4*c*.

According to FIG. 4*a*, first a pit is excavated and its wall is protected by a supporting liquid 18 (e.g. bentonite suspension) introduced between guide walls 16. Subsequently (FIG. 4*b*), a partition wall 17 is lowered, which is generally provided with perforations but has a closed structural element 17' in the lower portion. The further course is the same as described for FIG. 2, with the difference that filtering concrete 1 is introduced only on one side of the wall member 17' and that, hence, the ground water is lowered at this side of the wall only. The filtering concrete 1 becomes effective only when the sealing of the adjoining region has been neutralized by the supporting liquid, for example by partial dissolution of the sealing layer.

I claim:

1. A method of constructing a foundation body for reducing a ground water level comprising:

positioning a vertically elongated pile in an opening in the ground bearing the ground water level, the pile being vertically elongated and having a vertical opening extending therethrough;

providing said pile to include an upper load bearing part of water impervious material and a lower load bearing layer of water pervious material made of filtering concrete with a pipe which is water pervious at least in the area of said lower layer extending in a portion of said opening in said lower layer;

pumping out ground water through said pipe and said opening which has entered said opening through said lower layer; and adding water impervious material to said lower layer through said opening to render said lower layer water impervious.

2. A method according to claim 1, wherein said water impervious material comprises hardenable injected material.

3. A method according to claim 2, wherein said hardenable injected material comprises thin cement mortar.

4. A method according to claim 1, including drawing a hole in the ground bearing the ground water level, positioning the pipe in the hole, positioning a jacket in the hole around the pipe, filling a lower portion of the hole where the pipe is water pervious with filtering cement to form the lower layer, partly withdrawing the jacket from the hole, filling the remainder of the hole with water-impervious cement to form the upper layer and fully removing the jacket from the hole.

5. A method according to claim 4, including adding reinforcement irons in the hole between the jacket and the pipe for filling in the lower layer of filtering concrete.

6. A method according to claim 4, including providing a water impervious bladder in the portion of said pipe which is water pervious and inflating the bladder before forming the lower layer of filtering concrete.

* * * * *